US005549045A

United States Patent [19]

D'Heureuse et al.

[11] Patent Number: 5,549,045

[45] Date of Patent: Aug. 27, 1996

[54] METHOD AND DEVICE FOR CONVEYING FLEXIBLE PRINTING FORMS

[75] Inventors: Walter D'Heureuse, Ladenburg; Hans-Jürgen Kusch, Neckargemünd, both of Germany

[73] Assignee: Heidelberger Druckmaschinen AG, Heidelberg, Germany

[21] Appl. No.: 335,554

[22] Filed: Nov. 7, 1994

Related U.S. Application Data

[63] Continuation of Ser. No. 54,162, Apr. 26, 1993, abandoned.

[30] Foreign Application Priority Data

Apr. 24, 1992 [DE] Germany ..... 42 13 472.2

[51] Int. Cl.[6] ..... B41L 47/14

[52] U.S. Cl. ..... 101/477; 101/494

[58] Field of Search ..... 101/141, 142, 101/216, 232, 116–120, 477, 479, 494

[56] References Cited

U.S. PATENT DOCUMENTS

| | | | |
|---|---|---|---|
| 4,134,338 | 1/1979 | Selman | 101/127.1 |
| 4,236,448 | 12/1980 | Wieland | 101/216 |
| 4,507,167 | 3/1985 | Jahme et al. | 156/345 |
| 4,846,057 | 7/1989 | Endo et al. | 101/477 |
| 5,048,416 | 9/1991 | Iijima | 101/115 |
| 5,181,466 | 1/1993 | Ono | 101/477 |

FOREIGN PATENT DOCUMENTS

| | | | |
|---|---|---|---|
| 2337296 | 9/1975 | Germany . | |
| 3239580 | 4/1984 | Germany . | |
| 0355276 | 3/1991 | Japan | 101/477 |
| 1432390 | 4/1976 | United Kingdom . | |

*Primary Examiner*—Ren Yan

*Attorney, Agent, or Firm*—Herbert L. Lerner; Laurence A. Greenberg

[57] ABSTRACT

Device for conveying flexible printing forms away from a printing-form cylinder of a printing press includes a structure defining a conveying plane over which the printing forms are guidable, a conveying device leading away from the printing-form cylinder over a deflecting region adjacent to the conveying plane, and a feeding device cooperatively engaging the conveying device for feeding the printing forms to a repository.

8 Claims, 3 Drawing Sheets

METHOD AND DEVICE FOR CONVEYING FLEXIBLE PRINTING FORMS

This application is a continuation of application Ser. No. 08/054,162, filed Apr. 26, 1993, now abandoned.

BACKGROUND OF THE INVENTION

FIELD OF THE INVENTION

The invention relates to a method and device for conveying flexible printing forms and, more particularly, for conveying flexible printing forms from a printing-form cylinder of a printing press by conveying means leading away therefrom over a deflecting region adjacent to a conveying plane along which the printing forms are guided and to feeding means for feeding the printing forms to a repository.

It has become known, heretofore, to arrange rigid deflecting surface members in the form of rods or deflecting plates between the away-leading conveying means and the feeding means and above the conveying plane. With such an arrangement, it is possible, particularly for printing forms which have possibly been softened or even moistened by the preceding printing operation, that the printing forms which are to be pressed, by the conveying means leading away from the printing-form cylinder, against the deflecting surfaces and to be dsflected by the rigid deflecting surface members as the printing forms slide along the latter, adhere to the deflecting surfaces at points or over large areas thereof. The adhesion causes a canting of the printing form and/or a braking effect directed opposite to the conveying movement.

The consequently delayed conveyance of the printing form away from the printing-form cylinder impedes the exchange of the printing forms from being rapidly performed. Particularly with regard to printing foils, a crumpling of the printing foil and, thereby, a spatial expansion of the printing foil in the lateral direction can result from conveying action further acting upon the printing foil, or also due to the travel of the printing foil through opening gaps in the guiding region, damage to the conveying means, and due to a backwash of the printing forms into the printing-form cylinder region, even damage to the printing-form cylinder devices can occur. In the case of a timely stopping of the press, the removal of the obstructing printing form is, at the very least, a waste of time and work.

It is accordingly an object of the invention to provide a method and device for conveying flexible printing forms which permits reliable removal of the printing forms from the printing-form cylinder.

SUMMARY OF THE INVENTION

With the foregoing and other objects in view, there is provided, in accordance with the invention, a device for conveying flexible printing forms away from a printing-form cylinder of a printing press, comprising means defining a conveying plane over which the printing forms are guidable, conveying means leading away from the printing-form cylinder over a deflecting region adjacent to the conveying plane, and feeding means cooperatively engaging the conveying means for feeding the printing forms to a repository.

In accordance with another feature of the invention, both the conveying means and the feeding means comprise revolving members defining a gap therebetween through which the printing forms are conveyable by friction contact.

By means of the thus movable deflecting surfaces, it is possible that moistened or softened printing forms also can be conveyed along the movable deflecting surfaces to the repository. Because the deflecting surfaces entrain or move together with the respective printing form, the printing form is not pressed against a deflecting surface in opposition to large friction forces, but rather, is merely placed on a deflecting surface which then, due to its own movement, effects the deflection of the printing form. In the feeding region associated with the deflection, the printing forms can be fed reliably by conventional feeding means to the repository therefor. Particularly in the case of moist or softened printing foils, targeted action can thus be taken against the formation of static frictional forces.

In accordance with a further feature of the invention, means are provided which define a deflectingly curved guiding gap disposed in the deflecting region, the defining means having curved upper and curved lower guiding surfaces uniformly spaced from one another so as to define the gap, the guiding surfaces being movable in conveying direction of the printing forms. This construction provides a particularly reliable deflection of the printing forms. By the arrangement of deflecting surfaces movable together with the respective printing form on both sides of the latter, the likelihood that the printing form might stray away from the conveying planes is no longer possible.

In accordance with an added feature of the invention, the movable guiding surfaces are movable at a speed for conveying the printing forms. This construction affords a minimization of undesirable frictional forces between the deflecting surface and the printing form which act upon the printing form and cause a braking effect due to adhesion of the printing form to the printing surface.

In accordance with an additional feature of the invention, side frames are located at opposite sides of the device, and the lower guiding surface is formed by part of the outer cylindrical surface of a transport roller rotatably journalled in the side frames, and the upper guiding surface is formed on at least one revolving belt, and at least two guide rollers are rotatably mounted in the side frames, the belt being looped about the guide rollers and having a lower strand conforming to the part of the outer cylindrical surface over a deflecting angular sector of the transport roller for deflecting the conveying direction of the printing forms.

In accordance with yet another feature of the invention, means are included for driving the guiding surfaces of the means defining the gap. With this construction, the device according to the invention permits the exclusion of undesirable frictional effects.

In accordance with yet a further feature of the invention, one of the guide rollers is rotatably mounted upstream of the transport roller in the conveying direction of the printing forms, the one guide roller and the transport roller constituting means for guiding the printing forms away from the printing-form cylinder.

In accordance with yet an added feature of the invention, one of the guide rollers is rotatably mounted downstream of the transport roller in the conveying direction of the printing forms, the one guide roller and the transport roller constituting means for guiding the printing forms away from the printing-form cylinder.

In accordance with a concomitant feature of the invention, the belt and the transport roller constitute the conveying means and the feeding means.

In accordance with another aspect of the invention, there is provided a method of conveying flexible printing forms away from a printing-form cylinder of a printing press, which comprises deflecting travel of the printing forms in conveying direction thereof by movable deflecting surfaces, and directing the printing forms to a repository.

Other features which are considered as characteristic for the invention are set forth in the appended claims.

Although the invention is illustrated and described herein as embodied in a method and device for conveying flexible printing forms, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE INVENTION

DESCRIPTION OF THE PREFERRED EMBODIMENT

Figure 1:
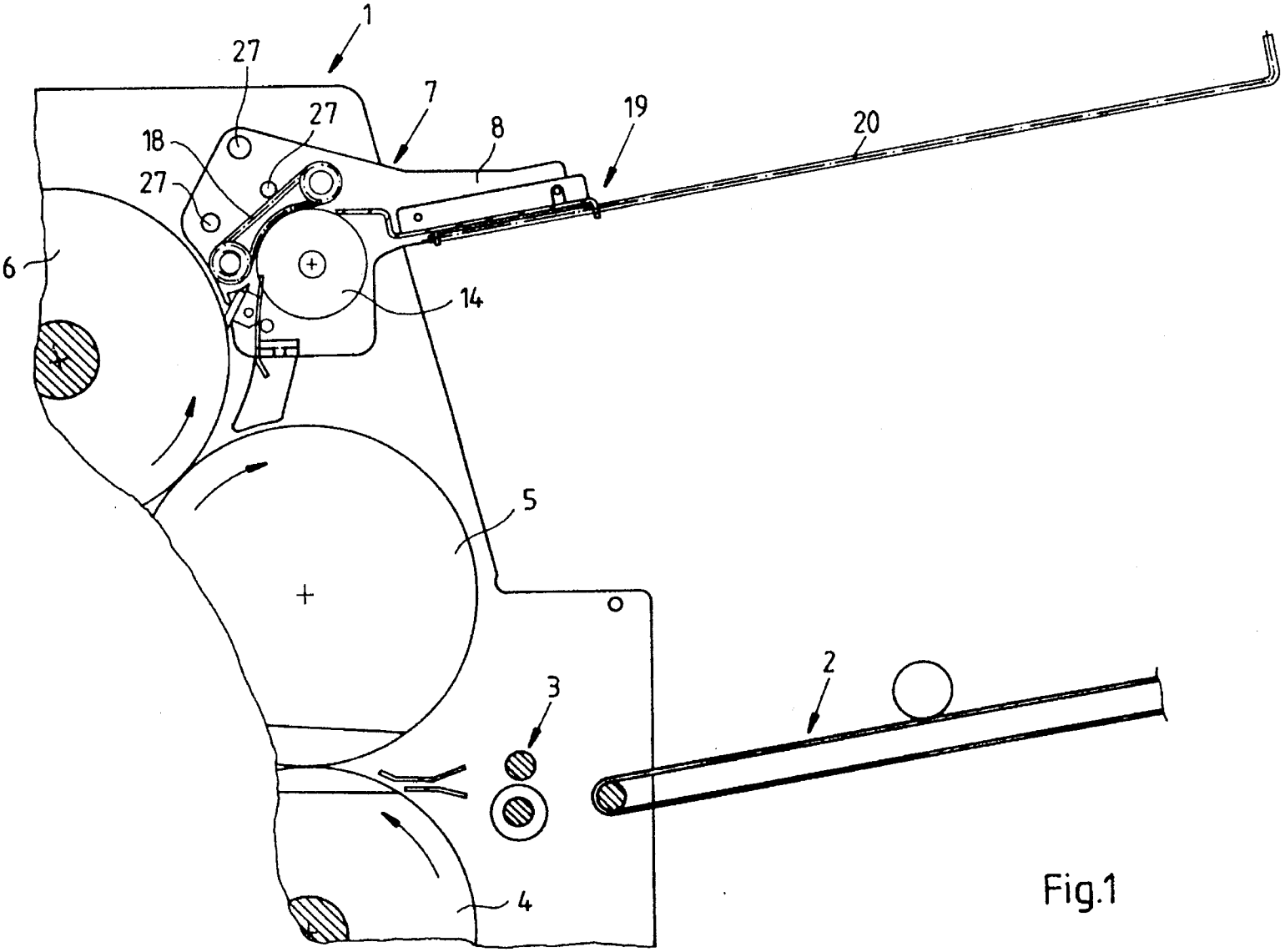
FIG. 1 is a fragmentary side elevational view of a sheet-fed offset printing press having arranged therein a device for conveying away printing foils which embodies the invention of the instant application.
Figure 2:
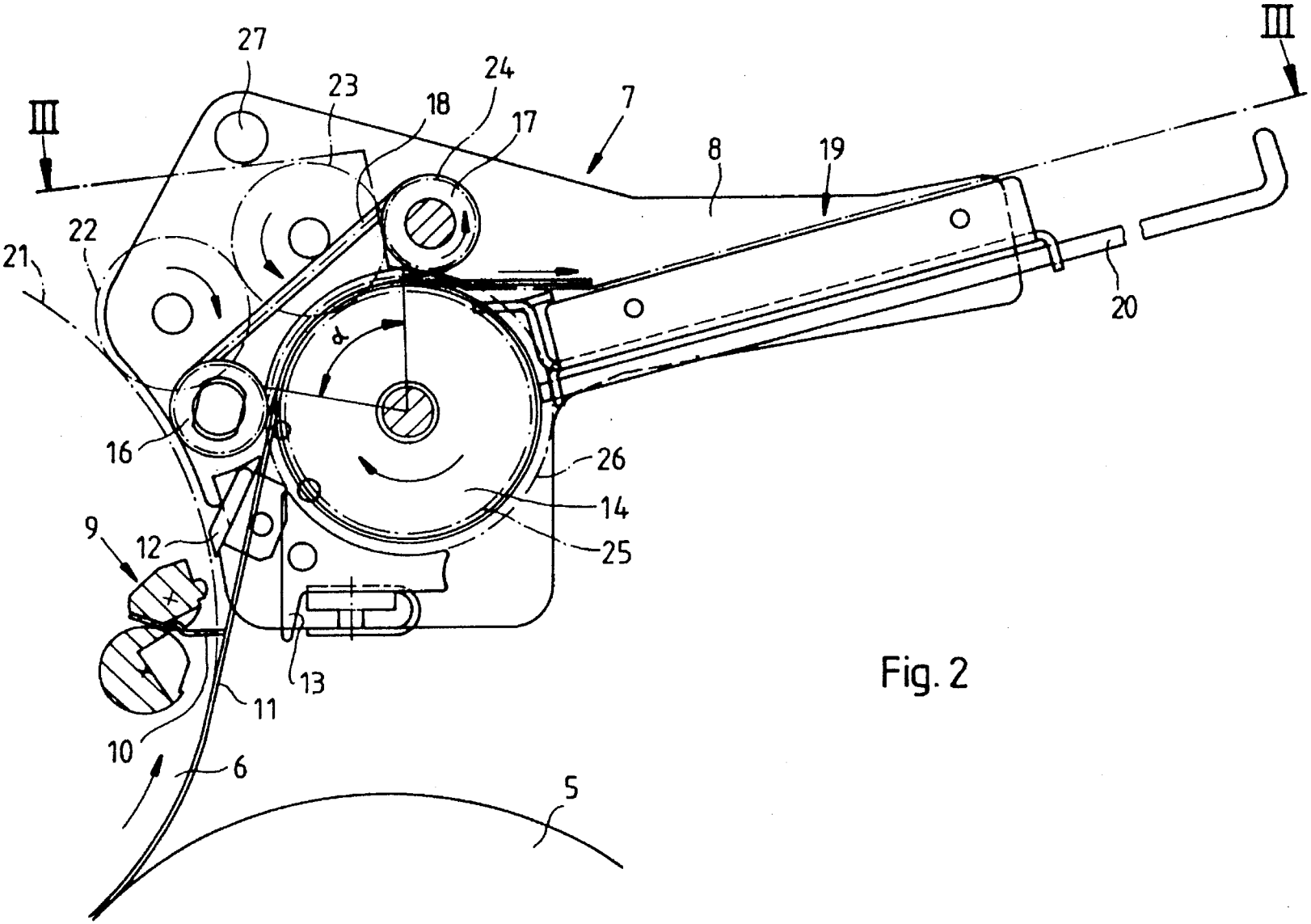
FIG. 2 is an enlarged fragmentary view of FIG. 1 showing the conveying device in greater detail.

Referring now to the drawings and, first, particularly to FIGS. 1 and 2 thereof, there is shown therein part of a small-format sheet-fed rotary offset printing press having a printing unit 1 wherein non-illustrated paper sheets are fed over a feed table 2 by feed rollers 3 to an impression cylinder 4. From a non-illustrated inking unit, ink is applied to a printing foil 11 clamped to a plate cylinder 6, and transferred from the printing foil 11 via a blanket cylinder 5 to a paper sheet fed into the nip between the blanket cylinder 5 and the impression cylinder 4, in a conventional manner. In order to remove the printing form 11, which is provided with a printing image, the leading edge of the printing form 11 is forced away from the plate cylinder 6 by means of an ejector finger 10 of a plate-clamping device 9, in a conventional manner, and is slid between two guide rakes 12 and 13 of a foil-removing device 7 by further rotation of the plate cylinder 6.

Figure 3:
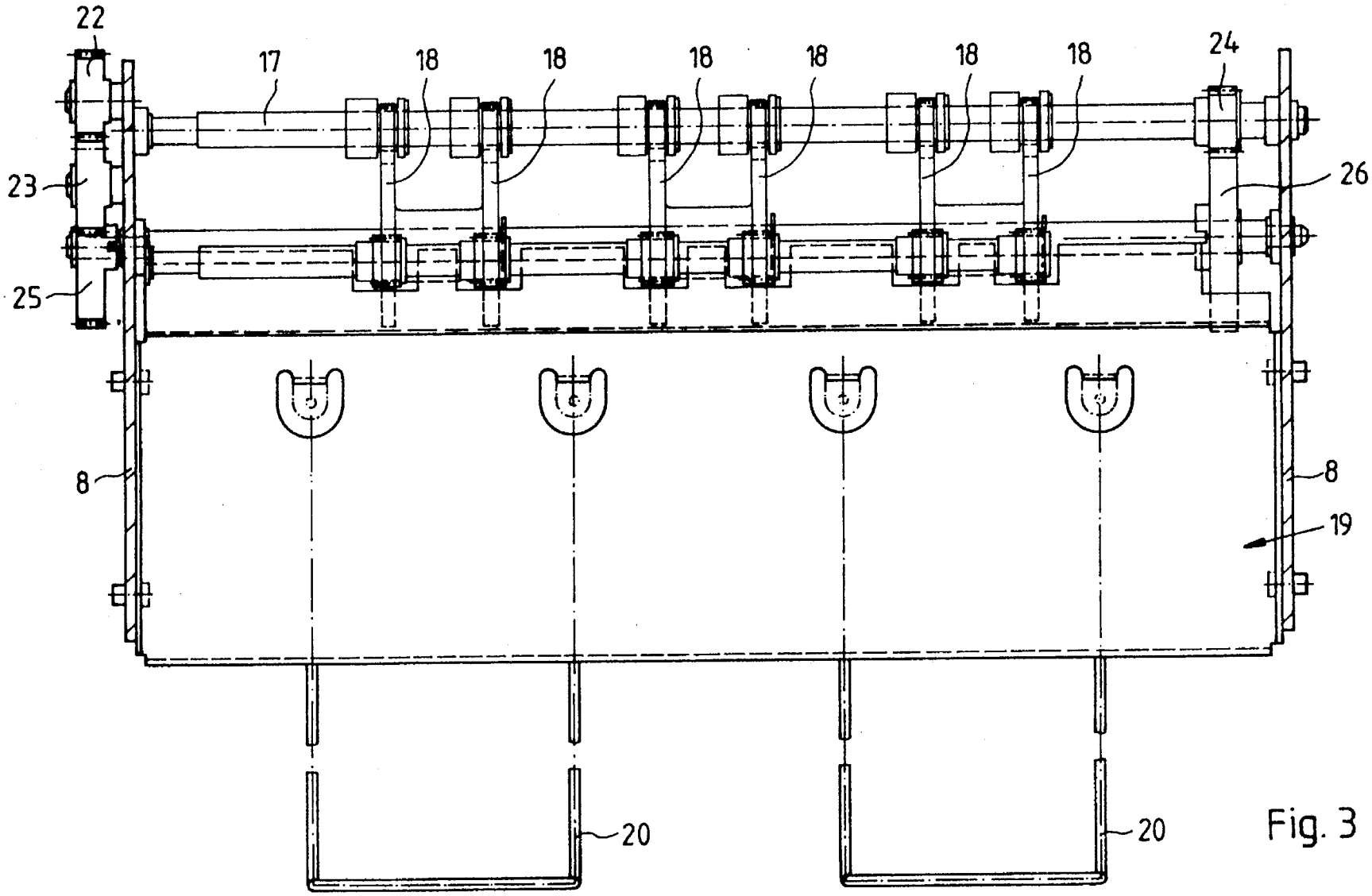
FIG. 3 is a sectional view of FIG. 2 taken along the line III—III in the direction of the arrows.

The foil-removing device 7 is formed, as shown in FIGS. 2 and 3, of a transport roller 14 extending between and rotatably journalled on two side walls 8 and two guide or deflecting rollers 16 and 17 also rotatably mounted between and on the side walls 8. Revolving belts 18 are guided over the guide rollers 16 and 17 and extend across the width of the foil-removing device 7, symmetrically to a center line of the width thereof. The guide rollers 16 and 17 are arranged so that an outer side of the lower strand of each of the conveyor belts 18, as viewed in FIG. 2, lies on the peripheral surface of the transport roller 14 over an angular sector $\alpha$ and is deflected in the direction of movement thereof by the transport roller 14 over this angular sector $\alpha$.

The guide roller 17 is connected coaxially with a gear 24 so as to be fixed against rotation relative thereto. The transport roller 14 is connected coaxially with gears 25 and 26 so as to be fixed against rotation relative thereto. The gear 25 is driven, via gears 23 and 22 which are rotatably mounted on one of the side walls 8, by a crown gear 21 connected coaxially with the plate cylinder 6 so as to be fixed against rotation relative thereto. The gear 24 meshes with the gear 26.

After the leading edge of the printing foil 11 has been pushed away from the plate cylinder 6 by the clamping device 9, it is slid between the guide rakes 12 and 13 fastened to the side walls 8 and into the nip formed between the guide roller 16 and the transport roller 14. The transport roller 14, which engages the printing foil 11 on the side thereof provided with the printing image, as well as the revolving belts 18, the lower strands of which act upon the printing foil 11 at the side thereof opposite to the side provided with the printing image, transport the printing foil 11, with a deflection of the printing-form conveying direction about the angle $\alpha$, to a deposit box 19 fastened to the side walls 8 at a location downstream from the transport roller 14, as viewed in the printing-foil conveying direction, the deposit box 19 being provided with displaceable retaining clips 20 for format adjustment.

The angular velocity of the strand of the belts 18 lying against the transport roller 14 in the angular sector $\alpha$ corresponds to the angular velocity of the transport roller 14.

The revolving belts 18 may be in the form of toothed belts for reliably entraining the printing foils 11, the teeth of the belts 18 corresponding with those of suitable gears provided on the guide rollers 16 and 17.

The foil ejecting device 7 can be inserted, with the aid of bolts 27 arranged in the side walls 8, into non-illustrated guides provided in the side frames of the press, and can be locked therein.

We claim:

1. In combination with a printing press having a printing-form cylinder, a device for conveying flexible printing forms away from the printing-form cylinder of the printing press, the device comprising:

a transport roller having a peripheral surface defining a conveying plane for conveying and deflecting flexible printing forms in a conveying direction away from the printing-form cylinder, said transport roller being rotatable through a given angle for defining a deflecting region on said peripheral surface thereof;

a flat repository disposed downstream of said transport roller as seen in the conveying direction for receiving the flexible printing forms; and a plurality of guide rollers and a conveyor belt supported on said guide rollers, said guide rollers and said conveyor belt being disposed adjacent said peripheral surface of said transport roller, a first one and a last one of said guide rollers pressing against said peripheral surface of said transport roller with a section of said conveyor belt disposed therebetween such that the printing form is received between said first one of said guide rollers and said transport roller, deflected through said deflecting region with said conveyor belt clamping the flexible printing form against said deflecting region on said peripheral surface, and the printing form is released from between said last one of said guide rollers and said transport roller for further transport to said flat repository for the printing forms.

2. The device according to claim 1, wherein said deflecting region defined on said peripheral surface of said transport roller and said conveyor belt define a gap therebetween.

3. The device according to claim 2, wherein said peripheral surface at said deflecting region and said conveyor belt are complementarily curved so as to define a curved gap.

4. The device according to claim 2, including guide rakes disposed between the printing-form cylinder and said gap formed between said transport roller and said conveyor belt, for guiding the flexible printing form from the printing-form cylinder into said gap.

5. The device according to claim 1, wherein said peripheral surface and said conveyor belt are movable at a speed for conveying the printing forms.

6. The device according to claim 1, including mutually meshing gears operatively connected between the printing-form cylinder and said transport roller for driving said transport roller.

7. The device according to claim 1, including means connected to said transport roller for driving one of said guide rollers with said transport roller.

8. A method of conveying flexible printing forms away from a printing-form cylinder of a printing press to a repository unit, which comprises:

providing a transport roller having a peripheral surface defining a deflecting region, a plurality of guide rollers and a conveyor belt supported on said guide rollers, a first one and a last one of said guide rollers pressing against said peripheral surface of said transport roller with a section of said conveyor belt disposed therebetween, said conveyor belt and the deflecting region of said transport roller defining mutually cooperating first and second deflecting surfaces, deflecting travel of a printing form through the deflecting region in a conveying direction thereof by moving the mutually cooperating first and second deflecting surfaces in a conveying direction of the printing form, and fixedly clamping the printing form between the first and second deflecting surfaces during travel of the printing form through the deflecting region, and deliverinq the printing form to a flat repository disposed downstream of the first and second deflecting surfaces as seen in the conveying direction.

* * * * *